United States Patent [19]

Spanel et al.

[11] 4,127,078

[45] Nov. 28, 1978

[54] YARN ADJUSTER FOR CONTROLLING EVENNESS OF YARN TUFTS

[75] Inventors: Abram N. Spanel, Princeton, N.J.; P. Frank Eiland, Stamford; David R. Jacobs, New Canaan, both of Conn.; David N. Buell, Littleton, Colo.

[73] Assignee: Abram N. Spanel, Princeton, N.J.

[21] Appl. No.: 811,955

[22] Filed: Jun. 30, 1977

[51] Int. Cl.[2] ..... D05C 15/16

[52] U.S. Cl. ..... 112/266; 112/79 FF

[58] Field of Search ..... 112/78, 79 R, 79 A, 112/79 FF, 80, 284, 262, 266, 302, 253, DIG. 1, DIG. 3

[56] References Cited

U.S. PATENT DOCUMENTS

| | | | |
|---|---|---|---|
| 3,216,387 | 11/1965 | Short | 112/79 FF |
| 3,257,981 | 6/1966 | Short | 112/79 FF |
| 3,937,156 | 2/1976 | Spanel | 112/79 FF |

*Primary Examiner*—H. Hampton Hunter

*Attorney, Agent, or Firm*—J. Rodman Steele, Jr.

[57] ABSTRACT

A yarn adjuster positioned adjacent tufting needles in a tufting machine for engaging yarn in close proximity to the tufting needles and moving it a predetermined distance to thereby control the length of the yarn on each side of the needles which controls evenness of tufts particularly when dual tufting needles are utilized to tuft U-shaped tufts. The yarn adjuster may be driven by an improved coupler point drive featuring long dwell and fast rise.

29 Claims, 14 Drawing Figures

YARN ADJUSTER FOR CONTROLLING EVENNESS OF YARN TUFTS

BACKGROUND OF THE INVENTION

The subject application discloses improved tufting apparatus which utilizes basic concepts from tufting techniques disclosed in U.S. Pat. No. 3,554,147 which issued to Abram N. Spanel and George J. Brennan on Jan. 12, 1971 and U.S. Pat. No. Re27,165 which issued Aug. 10, 1971 to Abram N. Spanel and Loy E. Barton.

The aforementioned U.S. Pat. No. Re27,165 discloses a pneumatic yarn transport system in which yarn is transported pneumatically to a tufting station where it is applied by tufting elements to a backing layer. Multicolor selection of the yarn is provided and for each needle station, there may be color choices of five, eight or any reasonable number of colors.

The aforementioned U.S. Pat. No. 3,554,417 describes an alternative system to U.S. Pat. No. Re27,165 and provides for the simultaneous selection of bit-lengths of yarn of various colors for each tufting cycle at each individual tufting station. A collator structure is utilized in which individual channels transport yarn into a common passageway adjacent the tufting station. In a preferred embodiment, the severing function takes place in close proximity to the tufting station after a selected yarn strand has been fed into the common passageway.

It is desirable in complex machinery such as the Spanel apparatus to not have to shift locations of major mechanisms. Accordingly, it is desirable to keep the cutting mechanism and the tufting elements in set locations, however, when this is done, the ability to obtain variable size products is reduced unless compensating adjustability mechanisms are provided.

In the preferred embodiment of the subject case, a yarn strand is pneumatically fed so as to extend past a yarn severing mechanism to dual tufting needles. The yarn strand is severed so that a yarn bit is loaded with it being desired that equal yarn lengths extend to the right and left of the dual needle which has its shanks in close proximity one to another. When the yarn bit is then tufted, equal tuft legs of a U-shaped tuft will be obtained.

It will be appreciated that if the yarn severing means is 1 inch from the tufting needles, then a bit-length of yarn of 2 inches will provide a tuft with approximately 1-inch legs (not counting the portion of yarn between tufting needles when dual needles are utilized). If 2-inch legs are desired, which means a bit-length of yarn of approximately 4 inches, must be provided, then it is obvious that if the severing means remains at the 1-inch distance from the tufting needles, one tuft leg will be 1 inch while the other tuft leg will be 3 inches, unless the yarn on each side of the tufting needles is equalized. Accordingly, yarn adjustment means to compensate for the above problems is desirable if selectability of different size tufts is to be a feature of such a tufting unit as above described.

BRIEF SUMMARY OF THE INVENTION

In accordance with the subject invention, the apparatus disclosed herein utilizes a means to control the evenness of tufts by positioning the yarn precisely as it is loaded or it is with each needle station loaded in the tufting needles. Yarn is fed to each tufting station comprising a pair of aligned needles having aligned eyes for receiving the yarn. The yarn is pneumatically fed and in a preferred embodiment, once the yarn is precisely positioned as disclosed herein, clamping of the yarn takes place to ensure that the precise positioning of the yarn is maintained through the tufting step.

The precise positioning of the yarn is achieved by a yarn adjuster disclosed herein which is positioned on the yarn feed side of the tufting needles between the severing means and the tufting needles. Once yarn has been transported or while it is being transported to the tufting needles, the yarn adjuster will be raised a predetermined amount as determined by the amount of yarn metered to ensure that equal lengths of the yarn are on each side of the tufting needles. The yarn adjuster extends the width of the machine and will position the yarn in all of the needle stations in one operation.

In view of the close proximity of various elements to one another, the yarn adjuster physically may comprise a bar-like element with a series of openings through which the yarn strands extend. As the bar is lifted, the yarn within the openings is raised as desired. The drive or carrier bar for the yarn lifter may be positioned upwardly over top of the needle station and openings or channels may be positioned therein to permit individual bit clamps to reciprocate to secure the yarn prior to the descent of tufting needles.

Coordination of the yarn lifter with a laser detection system (see copending application Ser. No. 811,968 may also be involved since immediately adjacent the severing means is a good location for the use of a laser beam to determine if malfunctions have occurred, i.e., yarn remains in this location after the descent of the tufting needles which indicates quite probably that yarn has not properly been severed.

In addition, disclosed herein is a unique drive featuring a long dwell and fast rise which is particularly adaptable for the yarn adjuster structure. This drive comprises the use of a four-bar linkage which together with a specific coupler point, provides a useful coupler point curve. The four-bar linkage is comprised of an eccentric, two moving links, and a fixed distance. The coupler point is a bearing which is a part of one of the links but is displaced to produce a drive which features a desired long dwell and fast rise.

BRIEF DESCRIPTION OF THE DRAWINGS

For a more detailed understanding of the invention, reference is made in the following description to the accompanying drawings in which.

DETAILED DESCRIPTION

Figure 1:
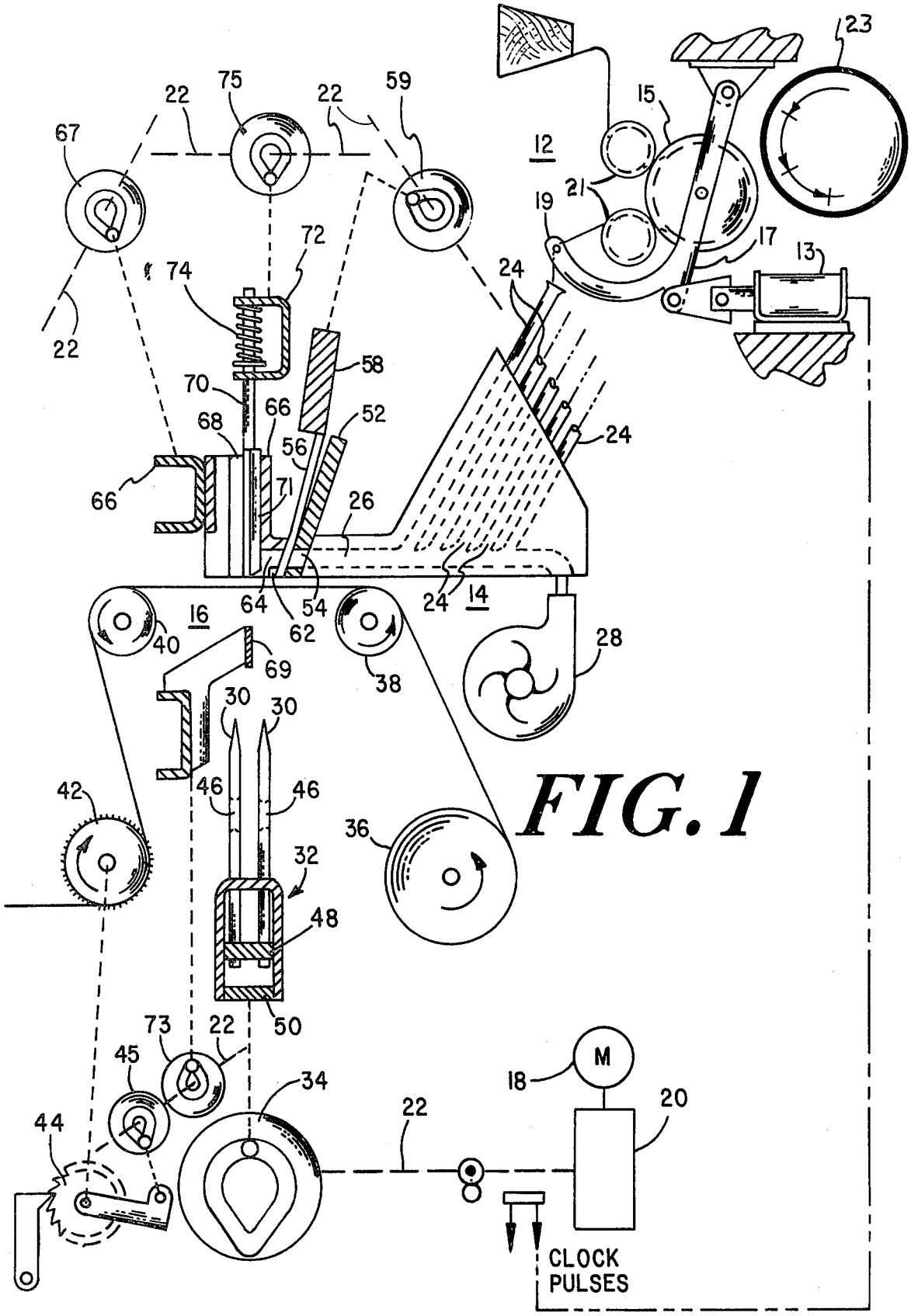
FIG. 1 discloses a schematic view of one embodiment of the tufting apparatus in which the subject yarn adjuster may be utilized.

With reference to FIG. 1, tufting apparatus as disclosed herein includes yarn selection and metering apparatus 12, pneumatic transport apparatus 14, and a tufting station 16. Each tufting station 16 is representative of as many as 1200 such tufting stations and for each tufting station there will be available some five or eight yarn strands each representing a different color or some other variable.

Control signals for operation of each selection actuation means for each selection and metering apparatus may be provided by any of various readout devices. To produce a desired pattern on a backing layer, pattern information recorded on tapes, drums or other medium is converted into electrical or other types of signals which, at the proper time with regard to the machine tufting cycle, as indicated by the dashed clock pulses of FIG. 1, are transmitted to the actuation means 13 for the yarn selection and metering apparatus. The selection actuator 13 may be a solenoid or it may be any suitable one of a variety of electrical, thermal, pneumatic or hydraulic, etc. type actuators. For details of selection and metering in the Spanel tufting system aforementioned U.S. Pat. Nos. 3,554,147 and Re27,165 should be consulted as well as U.S. Pat. No. 3,937,157 of which Abram N. Spanel and David R. Jacobs are inventors and co-pending application Ser. No. 699,904. A rotatable yarn feed mechanism 15 which may be on the order of that disclosed in U.S. Pat. No. 3,937,157 is shown in FIG. 1 together with intermediate linkage means 17 which extends from actuator 13 to rotatable yarn feed mechanism 15 and which also conrols the yarn pull-back mechanism 19 fully described in U.S. Pat. No. 3,937,157. The yarn feed mechanism also includes yarn guides 21 and drive roll 23. The selection and metering system including yarn pull-back means of co-pending application Ser. No. 699,904 may be used as well as the rotatable yarn feed mechanism.

A motor 18 is shown driving the machine by means of drive transmission 20 which may be a train of gears or comprise other mechanisms. A shaft 22 is schematically shown running throughout the device from which drive mechanisms operate as will be described subsequently.

Briefly, specific color selection signals are generated in response to the color requirements of a desired pattern, and for each of the color selection signals transmitted to a selection actuation means 13, a predetermined length of selected yarn is metered by yarn selection and metering apparatus 12 and advanced by pneumatic transport apparatus 14 through yarn guide tubes 24 so that the selected yarn strand extends into a common passageway 26 leading to tufting station 16 where it will be cut and the resultant yarn bit tufted into backing layer L. A pneumatic source 28 schematically shown provides the pneumatic supply for pneumatic transport apparatus 14. Reference may once again be made to U.S. Pat. No. 3,937,157 or co-pending application Ser. No. 699,904 for suitable pneumatic systems. The pull back mechanism 19 which is part of the yarn selection and metering apparatus 12 will remove the last-selected yarn strand from the common passageway 26 adjacent the tufting station after severance of the yarn bit, preparatory to the next color selection by the control signals.

At the tufting station, tufting needles 30 with aligned eyes receive the yarn strands preparatory to tufting. The needles 30 are mounted on a needle bar 32 which via cam drive 34 provides reciprocable motion to the needles 30.

The backing L may be fed from a supply roll 36 over roller member 38. Idler roll 40 directs the tufted product to the take-up pin roll 42 which operates from the ratchet and pawl mechanism 44 functioning off cam drive 45.

Figure 2:
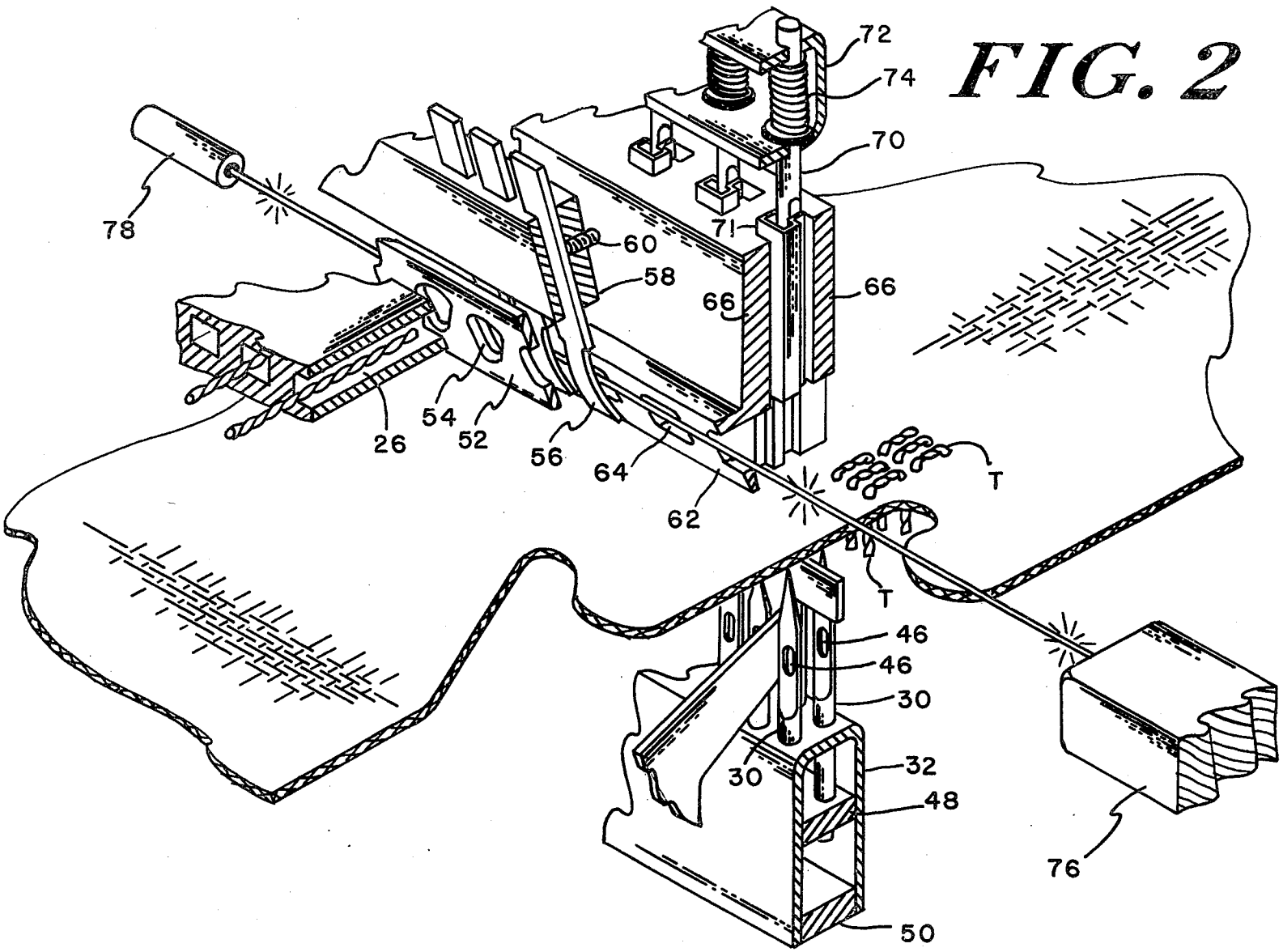
FIG. 2 is a perspective view showing a tufting station together with the yarn adjuster.

With reference to FIG. 1 and FIG. 2, the tufting station 16 is shown comprising needles 30 which have aligned eyes 46. Each individual tufting station comprises dual needles 30 on the order of those disclosed in aforementioned Reissue U.S. Pat. No. Re27,165. A needle bar 32 of lightweight construction aligns the needles 30 which are secured within the needle bar by needle bar insert member 48. A needle bar base plate 50 serves as mounting means for standard linkage structure which will drive the needle bar 32 by cam drive 34.

With further reference to FIGS. 1 and 2, a cutter mechanism stationary blade 52 having openings 54 is positioned adjacent common passageway 26 through which yarn extends toward each tufting station 16. Immediately adjacent the stationary blade 52, reciprocating blades 56 are positioned which are secured to reciprocating blade holder 58 which reciprocates in a widthwise direction with respect to the machine. This reciprocation is shown schematically as being provided by cam 59 in FIG. 1. Each individual reciprocating blade 56 is secured to reciprocating blade holder 58 by a locking and adjustment means 60 which may be on the order of a set screw device.

Adjacent the reciprocating blades, yarn adjuster 62 is shown having yarn openings 64 which align with the openings 54 of the stationary blade 52 to enable yarn strands to be pneumatically fed through to the tufting needles 30. The yarn adjustor 62 provides the tufting apparatus with the capability of selecting and tufting yarn of different lengths of produce rugs of different pile heights either on the same or different rugs. With reference to FIG. 2, U-shaped tufts are disclosed and it can be appreciated from FIGS. 1 and 2 that if different yarn lengths are metered by the yarn selection and metering apparatus 12 in the absence of some adjustment means, unequal tufts will result which will be of the nature of J-shaped rather than U-shaped since more or less yarn will be fed to the right of the needles 30 than the amount of yarn to the left of the needles 30 between the needles 30 and the cutting mechanism. Thus in constructing the apparatus disclosed herein, it is preferred to have the distance between the needles 30 and the reciprocating blade 56 be equal to the shortest tuft-leg length that will be produced on the machine. If longer tufts are desired, the additional necessary yarn is advanced by the metering means 12 and pneumatically fed to the needles 30 with the additional yarn being fed to the right of the needles 30. The yarn adjuster 62 will then rise lifting the yarn and pulling back one half of the additional yarn to the left of the needles prior to severance by the reciprocating blade 56 so that each tuft-leg will be equal and U-shaped tufts will result. It will be appreciated that the above designations of right and left of the needles were directed to the view as shown in FIG. 2. The terms should be reversed when viewing FIG. 1.

Yarn adjuster carrier bar 66 is shown being an integral part of the yarn adjuster 62 and vertical reciprocation of the yarn adjuster carrrier bar 66 is enabled through linkage by eccentric member 67 schematically shown in FIG. 1.

Yarn bit clamps 70 are shown which clamp the yarn against the backing layer L prior to tufting by the needles 30 and before, during or after severance of the yarn. A shiftable support member 69 is provided opposite the backing layer L from the clamps 70 to provide support for the backing layer. The support member 69 is controlled by cam member 73 and is cleared from its support position as the backing layer L is advanced.

The yarn bit clamp 70 is shown having hollow shields 71 into which extend the needle 30 of each needle pair which is closest to the yarn adjuster 62. The shield serves to prevent impalement of the yarn by the shielded needle 30 as it descends in close proximity to the yarn adjuster 62.

The yarn adjuster carrier bar 66 is shown having channels 68 through which the bit clamps 70 are permitted to reciprocate as does yarn adjuster carrier bar 66 although independent of each other. The bit clamps 70 are secured to bit clamp carrier bar 72 which is shown housing spring means 74 supported by flange support 148 for each of the individual bit clamps 70. As shown in FIG. 1, cam 75 provides the vertical reciprocation for carrier bar 72.

A laser 76 is shown which will be positioned on one extreme side of the machine while a photo detector 78 will be positioned at the opposite side of the laser aligned therewith so that the laser beam may be used to detect the presence of yarn in any of the channels at a time when such yarn should not be present. The presence of yarn at such a time indicates a malfunction.

Figure 3:
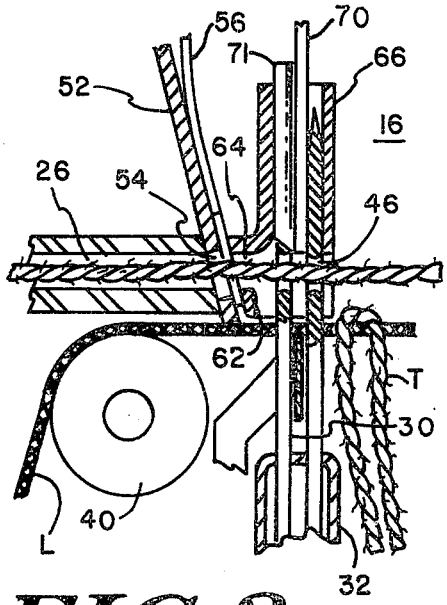
FIG. 3 is the first of four sequential cross-section views showing yarn being fed to the needle station through the yarn adjuster.

With reference to FIGS. 3–6, sequential cross-section views are shown of a single tufting station 16 in which the yarn adjuster 62 is being utilized. With reference to FIG. 3, the backing layer L is shown extending to the tufting station 16 over idler roll 40 and a tuft T is shown which has already been implanted from the preceding needle stroke. Yarn is shown being fed from the yarn selection and metering apparatus 12 (FIG. 1) through one of channels 24 to yarn channel 26 which is aligned with opening 54 of stationary knife blade 52, opening 64 of yarn lifter 62 and the aligned needle eyes or openings 46 of dual needles 30 or other suitable yarn applying means. The yarn is moving in FIG. 3 as the metered length from the yarn selection and metering apparatus 12 is being pneumatically advanced by the pneumatic transport apparatus 14, various embodiments of which have been described in detail in U.S. Pat. No. 3,937,157.

Figure 4:
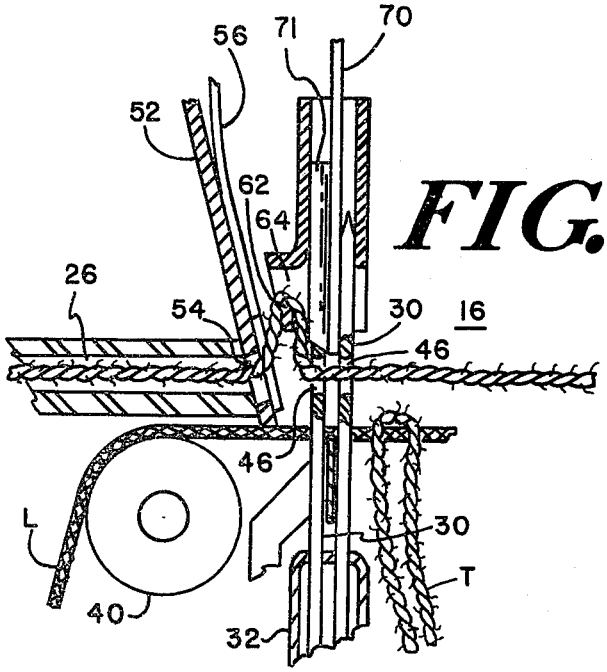
FIG. 4 is the second sequential cross-section view which shows the yarn adjuster moving up to precisely position the yarn.

With reference to FIG. 4, as the yarn reaches a certain point, the yarn adjuster 62 begins to ascend which causes incoming yarn to be lifted by adjuster 62 which effectively stops the downstream motion of the yarn past the needles 30.

Figure 5:
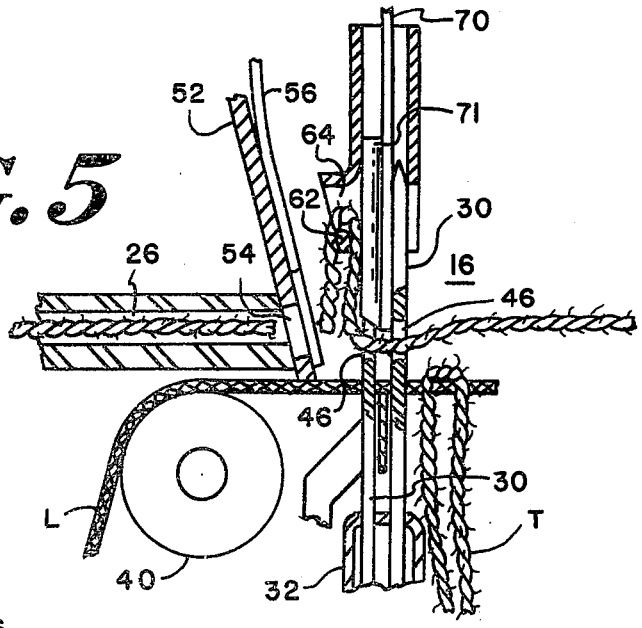
FIG. 5 is the third sequential cross-section view showing the yarn adjuster in its final position of ascent at which time the yarn is severed preparatory to tufting.
Figure 6:
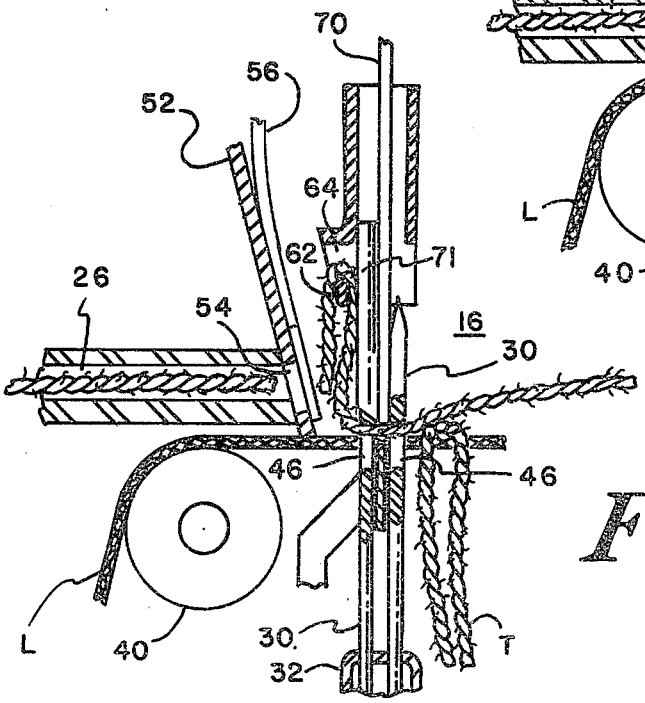
FIG. 6 is the fourth and final sequential cross-section view showing the severed bit-length of yarn being tufted.

As shown in FIG. 5, once the full length of yarn which has been selected and metered by the yarn selection and metering apparatus 12 reaches the tufting station 16, yarn movement in the downstream direction stops. The yarn adjuster 62 will continue to move upwardly a predetermined distance, which distance will be dependent on the amount of yarn metered from the metering apparatus 12. The continued movement of the yarn adjuster 62 to its predetermined position will then draw back yarn from the length of the yarn strand which extends to the right of needles 30. Thus, raising the yarn adjuster 62 to a predetermined height causes the length of yarn downstream or to the right of needles 30 to be the same length as the yarn to the left of needles 30 which extends over adjuster 62 to the cutter mechanism comprising stationary blade 52 and reciprocating blades 56. Once the yarn adjuster 62 reaches this predetermined raised position, the reciprocating blade 56 will be driven either to the right or left since cuts can be made on either side of the individual blades and the yarn will be severed to leave a predetermined bit-length of yarn loaded in the aligned eyes 46 of needles 30. The yarn is clamped as shown in FIG. 6 by yarn bit clamp 70 and the needles 30 or other suitable bit applying means may then descend causing the bit-length of yarn which has been severed to be pulled downwardly through the backing layer L and implanted to form a U-shaped tuft on the order of preceding tuft T. Once the yarn has been implanted, the backing layer L is shifted forward and the needles ascend to the loading position. The yarn adjuster 62 descends so that yarn for the next tuft may be fed through yarn passageway 26, through openings 54 and 64 and into aligned eyes 46 in the manner of the preceding yarn feed discussed about with respect to FIG. 3.

Thus, it can be appreciated that by controlling the height of ascent of the yarn adjuster 62, the length of the sides of each tuft may be controlled. Normally in the case of U-shaped tufts, it will be desirable to have the length of each side of the tuft equal and accordingly, the yarn adjuster 62 will be adjusted to cause approximately one-half of the metered yarn bit-length to extend between needles 30 and the cutter mechanism (over yarn adjuster 62).

It will be appreciated that J-shaped tufts may also be produced by controlling the ascent of the yarn adjuster 62. For patterning effects on certain types of rugs, this control feature is particularly desirable.

As can be appreciated, a great advantage of the yarn adjuster 62 is to provide a means by which different bit-lengths of yarn may be metered from the metering apparatus and tufted with equal sides of the U-shaped tuft being possible without the necessity of changing the distance between the severing mechanism and the needle position. It will be appreciated that without the yarn lifter bar, it would be necessary to change the relative distance between severing mechanism 52, 56 and needles 30 according to the yarn length which was being metered.

In previous patents, such as U.S. Pat. No. 3,937,156, means of shifting the severing mechanism were disclosed, however, the present invention offers a very attractive alternative to having to adjust a complex machanism such as the severing mechanism. In certain rug productions to achieve a patterning effect, it is desirable that different sized tufts be tufted on a single carpet. By utilizing the adjustability of yarn adjuster 62 together with the ability to meter different yarn lengths from metering apparatus 14 it is possible to rapidly change the yarn bit-length yet nevertheless provide a tuft with each of its sides being equal in length.

Figure 7:
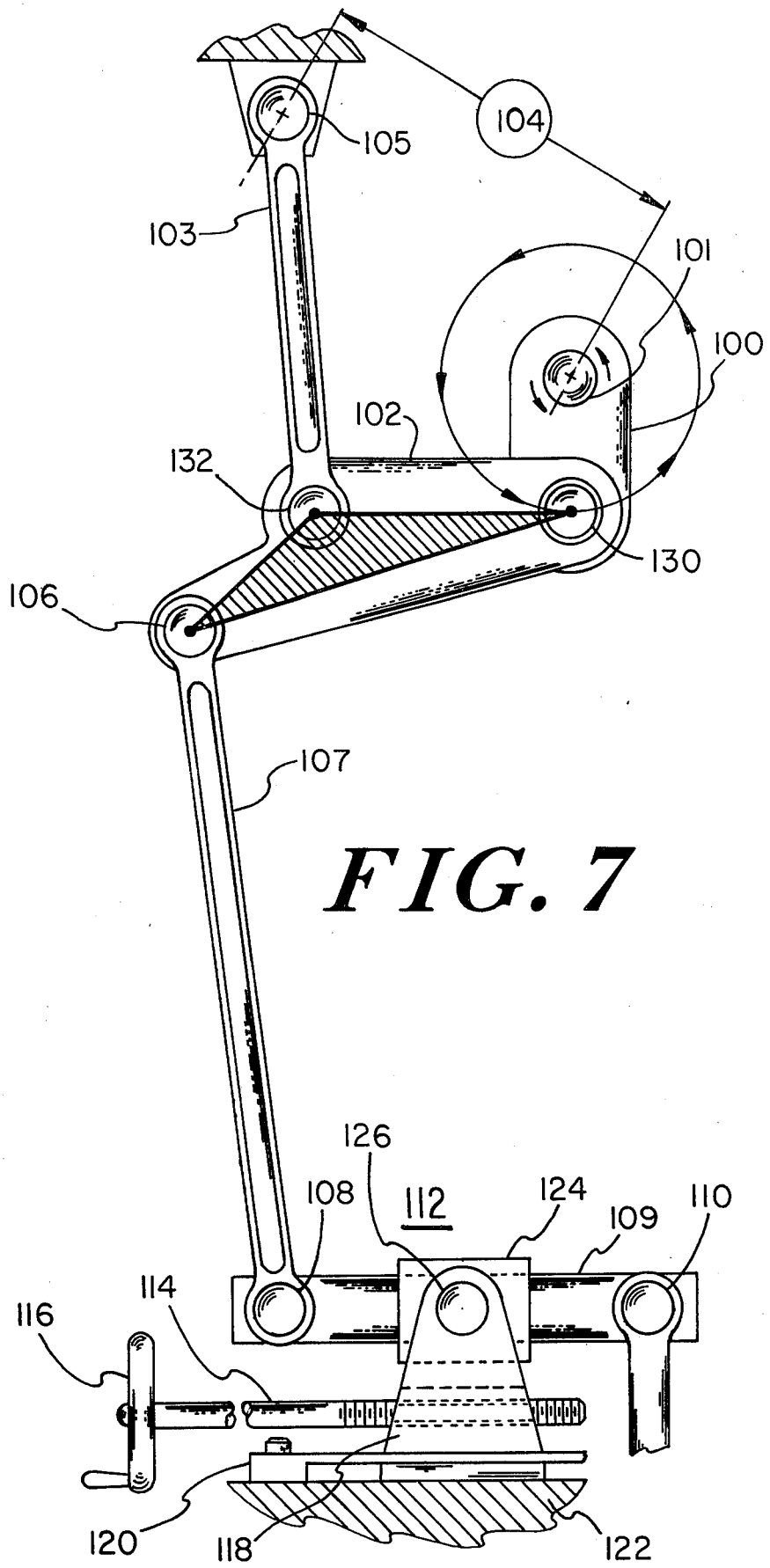
FIG. 7 is a front elevational showing the coupler point drive mechanism.

With reference to FIG. 7, the drive for the yarn adjuster 62 comprises a coupler point drive based upon a four bar linkage. The four bar linkage is comprised of an eccentric having an eccentric arm 100, moving links 102 and 103, and a fixed distance 104. The moving link 103 is oscillatory around bearing 105. The center of rotation 101 of the eccentric 100 and bearing 105 are fixed. A bearing 106 which is part of moving link 102 serves as the coupling point. Moving link 102 is rotatably secured to eccentric arm 100 by bearing 130 and to moving link 103 by bearing 132.

With further reference to FIG. 7, connecting link 107 extends from the coupler point 106 to its lower end 108 where it is secured to rocker arm 109. The rocker arm 109 is connected to output shaft 110. The drive is shown in FIG. 7 in a general position with the plane of the rigid member containing link 102 and coupler point 106 shaded.

With further reference to FIG. 7, an adjustable fulcrum unit 112 is disclosed which provides a means of adjustment for the yarn adjuster 62. An adjustable jack screw 114 is controlled by handwheel 116 with the jack screw 114 being used to adjust fulcrum clevis 118. A bearing and gib assembly 120, one side of which is shown in FIG. 7 is used to maintain alignment of fulcrum clevis 118 and prevent if from rising off of base member 122. As can be appreciated, arms of the bearing and gib assembly extend on each side of the fulcrum clevis 118. The fulcrum 118 is secured to rocker arm sleeve 124 by connecting means 126. Thus, the rocker arm 109 is stabilized and any pivotal or rocking motion of the fulcrum clevis 118 is controlled. As the handwheel 116 is turned, the clevis 118 will be drawn to the left or pushed to the right within the confining structure of the bearing and gib assembly 120 to change the fulcrum point as desired.

Figure 8:
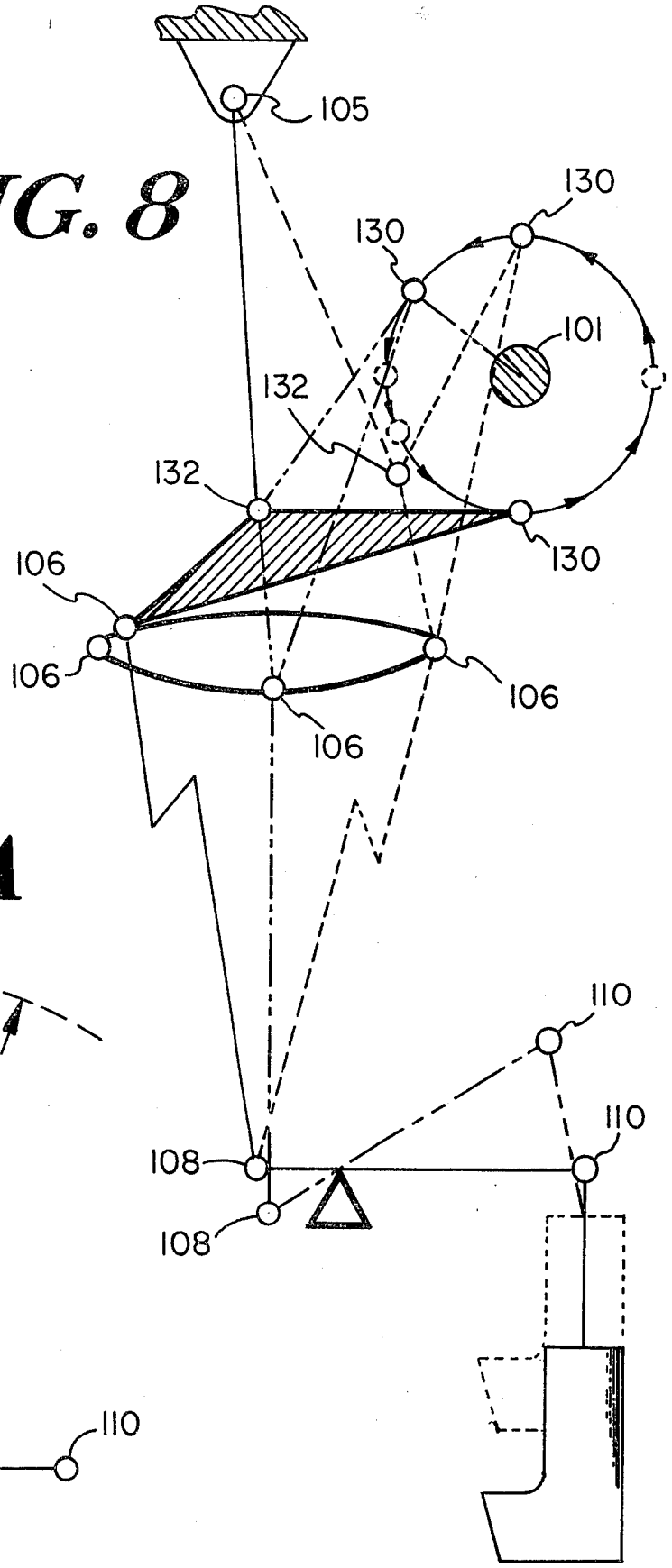
FIG. 8 is a schematic also depicting the coupler point drive mechanism.

With reference to FIG. 8, as the eccentric arm 100 rotates counterclockwise from the shaded position (FIG. 7—270°) the coupler point describes the curve shown. The coupler point curve has a characteristic shape of two approximately circular arcs. The upper arc requires much more time (to grease an eccentric rotation) than the lower arc. This can be appreciated by comparing the approximate positions of the eccentric from left to right on the upper arc (215° to 90°) and right to left on the lower arc (90° to 215°). These approximate values indicate that the upper arc requires approximately 235° to traverse and the lower arc requires 125° to traverse.

When the rocker arm 109 is utilized to drive an output shaft such as 110 which is positioned so that the connecting link 107 has its lower end 108 located in the center of circle of best fit to the upper coupler point arc, a long dwell and fast rise result which is ideally suited for the yarn adjuster drive. This arrangement will result in little or no movement of rocker arm 109 while the coupler point traverses most of the upper arc. At the end of this dwell, the coupler point moves very rapidly to a position causing maximum displacement of the rocker arm 109 and the output shaft 110.

Figure 8A:
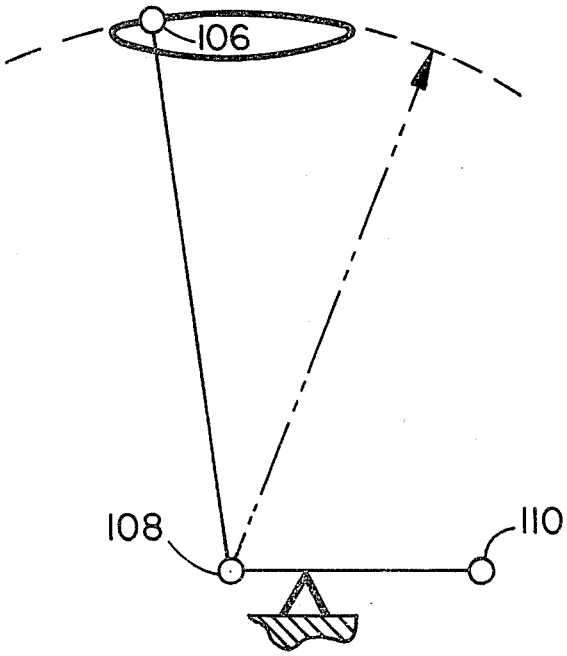
FIG. 8A is a partial schematic showing the relationship of the top of the ellipse formed by the output of the coupler point versus the radius about the output lever.

With reference to FIG. 8A, it will be seen that the top of the ellipse that is formed by the output of the coupler point is a radius about the rocker arm 109 so that all of the time that the coupler point is proscribing at top part of the ellipse, nothing moves on the rocker arm. This creates the dwell condition during which the output lever or rocker arm 109 is stationary.

Figure 9:
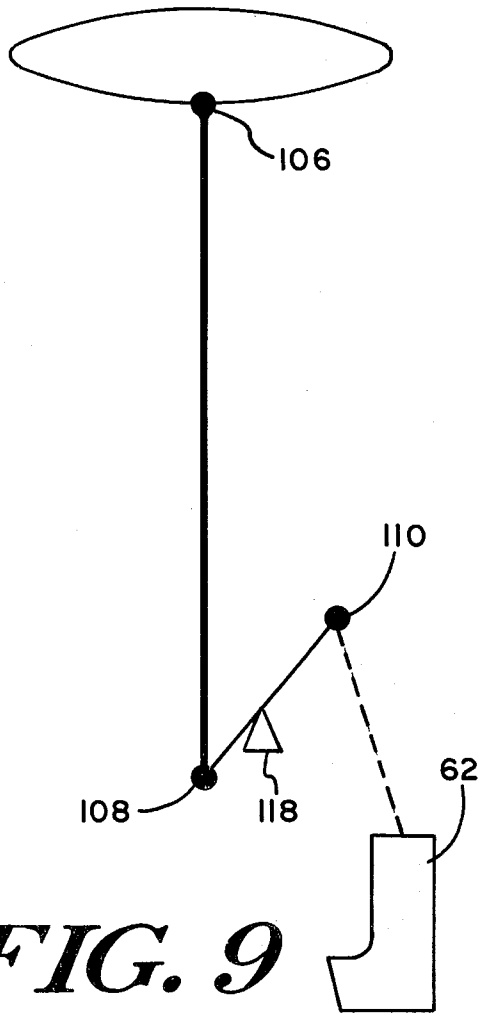
FIG. 9 is a schematic showing the drive mechanism adjusted to produce maximum length pile heights with the mechanism shown in its engaging position.

With reference to FIG. 9, a schematic shows yarn adjuster 62 in its maximum raised position with the clevis 118 so positioned to give the maximum heighth which would be for the creation of rugs with the longest pile lengths that the machine could produce.

Figure 10:
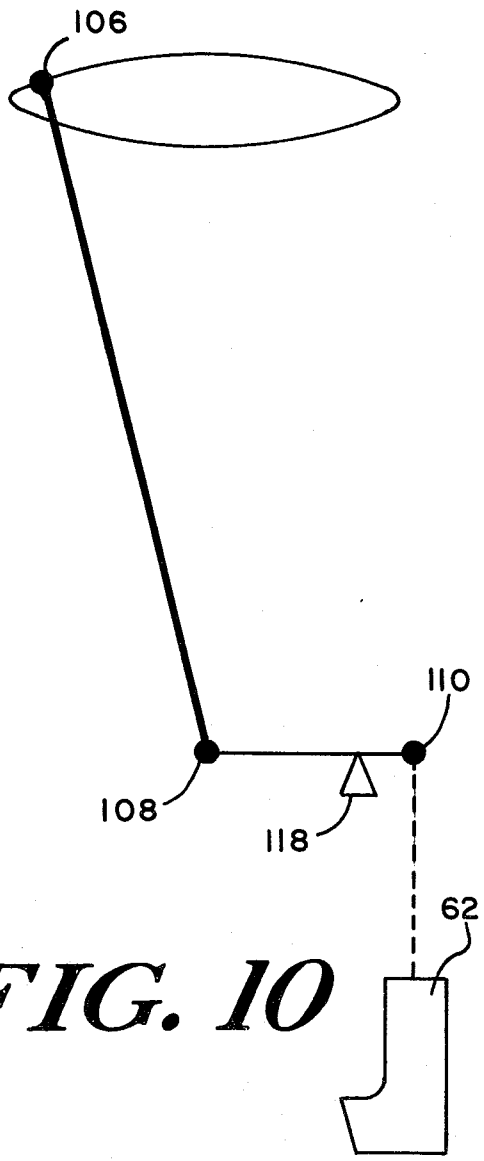
FIG. 10 is a schematic showing the drive mechanism adjusted to produce minimum length pile heights with the mechanism shown in its non-engaging position.

FIG. 10 shows the clevis 118 positioned far to the left which during the rise portion of the cycle will cause yarn adjuster 62 to rise only a small amount for short pile tufts. As can be seen in FIG. 10, a dwell condition is present as the coupler point passes through the upper portion of the ellipse.

Figure 11:
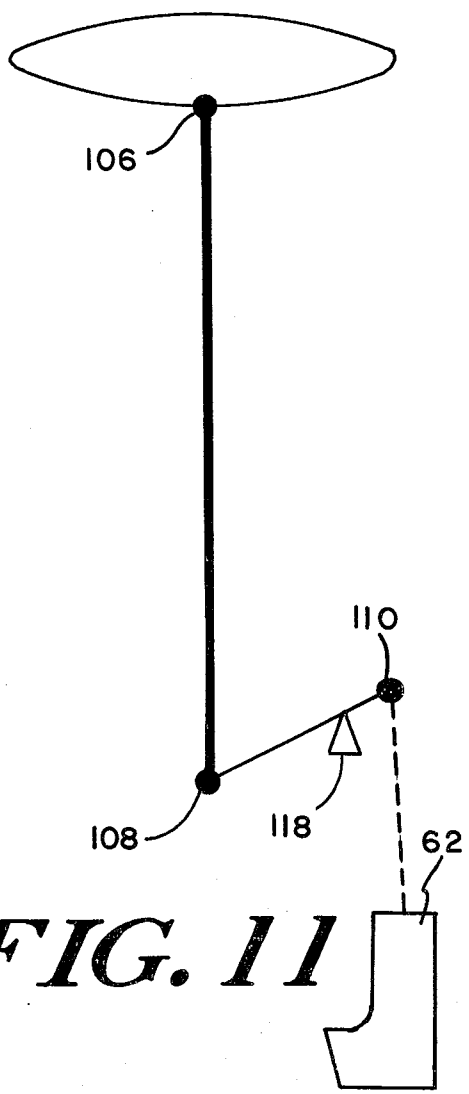
FIG. 11 is a schematic showing the adjustment of FIG. 10 only with the mechanism shown in its engaging position.

FIG. 11 shows the clevis in the same position as FIG. 10 only the mechanism is in the actuation period as yarn adjuster 62 rises for adjusting yarn for a relatively short pile heighth.

Figure 12:
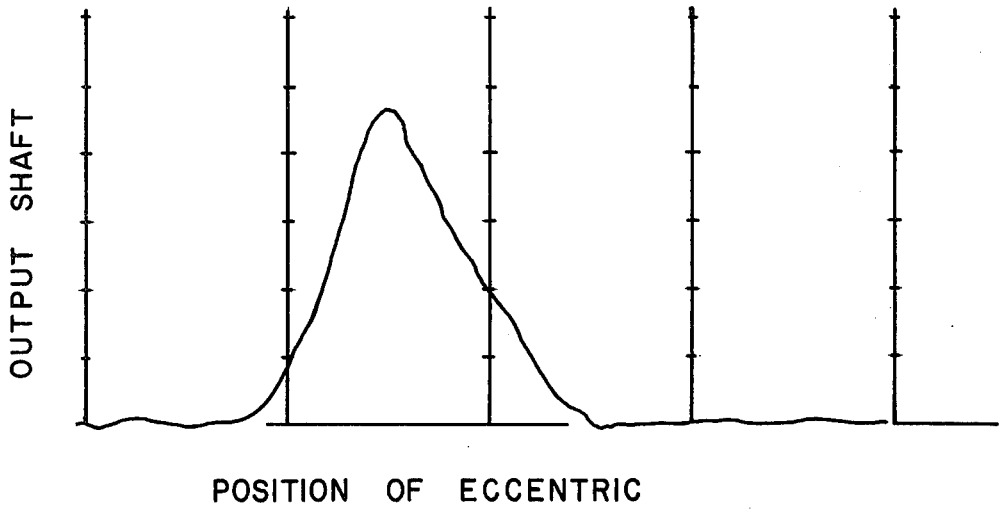
FIG. 12 is a graph showing angular displacement of the output shaft versus the position of the eccentric of the drive mechanism.

FIG. 12 shows a typical angular displacement of the output shaft 110 versus the position of eccentric arm 100.

Figure 13:
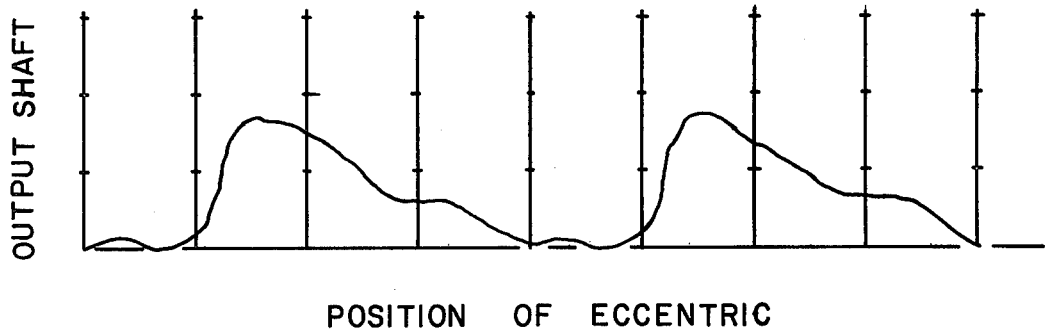
FIG. 13 is a graph showing the variables of FIG. 12 with the position of an element charged to give a different output.

With reference to FIG. 13, although not used for the yarn adjuster 62, a variation in output may be obtained by choosing particular portions of the upper arc in determining the position of lower end 108 of connecting link 107. For example, if the right side of the upper arc is used to determine the position of lower end 108 and the length of connecting link 107 and rotation of the output shaft 110 will be typically as shown in FIG. 13.

The present invention may be embodied in other specific forms without departing from the spirit or essential attributes thereof, and accordingly, reference should be made to the appended claims, rather than to the foregoing specification as indicating the scope of the present invention.

What is claimed is:

1. Tufting apparatus or the like including:

yarn-applying means for applying yarn to a backing layer wherein the improvement comprises a means for positioning yarn in a loaded condition in said yarn-applying means which comprises a yarn adjuster to position yarn in said yarn-applying means by causing at least a portion of the yarn to be drawn back.

2. The tufting apparatus or the like of claim 1 wherein said yarn adjuster moves in a variant direction from the axial path of the yarn adjacent said yarn-applying means.

3. The tufting apparatus or the like of claim 1 further comprising a means for severing yarn into a yarn bit subsequent to said yarn being positioned in a loaded condition in said yarn-applying means by said yarn adjuster.

4. The tufting apparatus or the like of claim 3 wherein said yarn adjuster can be adjusted to different positions with respect to said yarn-applying means.

5. The tufting apparatus or the like of claim 4 further including a metering means wherein said yarn adjuster is adjustable to position yarn at different predetermined positions which correspond to lengths of yarn metered by said metering means.

6. The tufting apparatus or the like of claim 1 wherein the yarn is pneumatically fed to said yarn-applying means before said yarn adjuster positions the yarn.

7. The tufting apparatus or the like of claim 1 further including clamping means for clamping the yarn before application to the backing layer.

8. The tufting apparatus or the like of claim 1 wherein said yarn-applying means comprises tufting needles having openings for receiving the yarn and wherein said yarn adjuster is a reciprocating yarn lifter.

9. The tufting apparatus or the like of claim 8 wherein said yarn lifter has an aligned opening adjacent to a corresponding needle opening.

10. The tufting apparatus or the like of claim 9 wherein tufting needles are arranged in pairs so that each tufting station comprises a set of dual tufting needles having aligned openings.

11. The tufting apparatus or the like of claim 1 further including yarn selection and metering means by which one of a series of yarns is selected for each yarn-applying means and a predetermined amount of yarn is metered prior to the yarn being loaded in each of said yarn-applying means.

12. The tufting apparatus or the like of claim 1 wherein said yarn adjuster comprises a bar-like member which extends widthwise across said tufting apparatus and which is reciprocatory.

13. The tufting apparatus or the like of claim 12 wherein said bar-like member has yarn openings corresponding to each of the yarn-applying means.

14. The tufting apparatus or the like of claim 12 further including clamping apparatus for clamping yarn in each of said yarn-applying means and wherein said yarn adjuster also includes structure adjacent said yarn clamping means.

15. The tufting apparatus or the like of claim 1 wherein said yarn adjuster is reciprocatory and is driven by a coupler drive mechanism providing long dwell during the time when the yarn adjuster is not adjusting yarn, and fast rise during the time when the yarn is being adjusted.

16. The tufting apparatus or the like of claim 15 wherein said coupler drive comprises:

an eccentric including eccentric arm;

a first bearing positioned a fixed distance from said eccentric;

a second bearing which provides a coupler point;

a first moving link connecting said eccentric arm with said second bearing;

a second moving link mounted to said first moving link and extending to said first bearing;

an output shaft;

a rocker arm connected to said output shaft; and a connecting link extending from said second bearing to said rocker arm.

17. The tufting apparatus or the like of claim 16 wherein said rocker arm which drives said output shaft is positioned so that the joining end of said connecting link which joins said rocker arm is located on the center of the circle of best fit to the coupler point as created by its movement.

18. The tufting apparatus or the like of claim 17 further including a means of adjustment wherein the movement of said yarn adjuster is controlled.

19. The tufting apparatus or the like of claim 18 wherein the means of adjustment comprises a fulcrum clevis mechanism.

20. The tufting apparatus or the like of claim 19 wherein said yarn adjuster is reciprocatory and the degree of reciprocation is controlled by the adjustment means.

21. The tufting apparatus or the like of claim 20 further including means of metering yarn to said yarn-applying means and wherein the adjustment of said adjustability means is correlated to the amount of yarn metered by said metering means.

22. A method of applying yarn bits to a backing layer comprising the steps of:

pneumatically feeding yarn to bit-applying elements;

adjusting said yarn a predetermined amount to control placement of the yarn in said bit-applying elements by causing at least a portion of the yarn to move in a variant direction;

severing said yarn into yarn bits when loaded in said bit-applying elements; and applying the severed yarn bits to the backing layer.

23. The method of claim 22 further comprising the step of selecting one of a series of yarns for each of a number of bit-applying stations and metering a predetermined amount of the selected yarn.

24. The method of claim 23 further comprising the step of adjusting the mechanism which adjusts yarn a predetermined amount according to the predetermined amount of yarn which has been metered.

25. The method of claim 22 further including the step of clamping the yarn bit when loaded in said bit-applying elements.

26. Tufting apparatus or the like including means for pneumatically transporting yarn from yarn storage to a tufting station, said tufting station comprising:

dual tufting needles including thread receiving means therein;

pneumatic guides through which yarn is fed; and, means for adjusting the positioning of yarn including a means to withdraw an incremental portion of yarn from said tufting needles.

27. Tufting apparatus or the like including means for pneumatically transporting yarn from yarn storage to a tufting station, said tufting station comprising:

dual tufting needles including thread receiving means therein;

pneumatic guides through which yarn is fed; and, means for adjusting the positioning of yarn including a means to adjust yarn as it is being threaded in said tufting needles.

28. Tufting apparatus or the like including means for pneumatically transporting yarn from yarn storage to a tufting station, said tufting station comprising:

dual tufting needles including thread receiving means therein;

pneumatic guides through which yarn is fed; and, means for adjusting the positioning of yarn bits including a means to adjust yarn as it is being fed to said tufting needles and further to withdraw an incremental portion of yarn from said tufting needles.

29. Tufting apparatus or the like comprising:

bit-applying elements for applying yarn to a backing layer;

means for pneumatically transporting yarn to said bit-applying elements;

means for severing yarn into yarn bits when the yarn is loaded in the bit-applying elements, said severing means being positioned near to said bit-applying elements; and means positioned between said bit-applying elements and said severing means to adjust the yarn prior to severance.

* * * * *

UNITED STATES PATENT OFFICE

CERTIFICATE OF CORRECTION

Patent No. 4,127,078 Dated Nov. 28, 1978

Inventor(s) Abram N. Spanel, P. Frank Eiland, David R. Jacobs, and David N. Buell It is certified that error appears in the above-identified patent and that said Letters Patent are hereby corrected as shown below:

Column 4, line 57, delete "of", and insert --to--.
Column 6, line 39, delete "about" and insert --above--.
Column 7, line 1, delete "machinism" and insert --mechanism--.
Column 7, line 34, delete "if" and insert --it--.

Signed and Sealed this

*Twenty-seventh* Day of *March 1979*

[SEAL]

*Attest:*

RUTH C. MASON
*Attesting Officer*

DONALD W. BANNER
*Commissioner of Patents and Trademarks*